US009948036B2

(12) United States Patent
Nishiyama

(10) Patent No.: US 9,948,036 B2
(45) Date of Patent: Apr. 17, 2018

(54) CONNECTOR HAVING SHORT CIRCUIT TERMINAL

(71) Applicant: YAZAKI CORPORATION, Tokyo (JP)

(72) Inventor: Noritaka Nishiyama, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/677,451

(22) Filed: Aug. 15, 2017

(65) Prior Publication Data

US 2018/0069353 A1 Mar. 8, 2018

(30) Foreign Application Priority Data

Sep. 5, 2016 (JP) ..... 2016-172796

(51) Int. Cl.

| | |
|---|---|
| ***H01R 31/08*** | (2006.01) |
| ***H01R 13/703*** | (2006.01) |
| ***H01R 13/46*** | (2006.01) |
| ***H01R 13/639*** | (2006.01) |
| ***H01R 13/436*** | (2006.01) |
| ***H01R 29/00*** | (2006.01) |
| ***H01R 4/48*** | (2006.01) |

(52) U.S. Cl.

CPC ..... *H01R 13/7032* (2013.01); *H01R 4/48* (2013.01); *H01R 13/4362* (2013.01); *H01R 13/46* (2013.01); *H01R 13/639* (2013.01); *H01R 29/00* (2013.01)

(58) Field of Classification Search

CPC ..... H01R 31/08; H01R 31/085
USPC ..... 439/507, 510, 513
See application file for complete search history.

(56) References Cited

U.S. PATENT DOCUMENTS

| | | | | |
|---|---|---|---|---|
| 7,351,084 | B2 * | 4/2008 | Ohtaka | H01R 13/701 439/188 |
| 2004/0102086 | A1 * | 5/2004 | Bigotto | H01R 13/639 439/507 |
| 2007/0054547 | A1 * | 3/2007 | Ohtaka | H01R 13/7032 439/507 |
| 2015/0140846 | A1 | 5/2015 | Kanemura | |

FOREIGN PATENT DOCUMENTS

JP 2015-099683 A 5/2015

* cited by examiner

*Primary Examiner* — Gary Paumen
(74) *Attorney, Agent, or Firm* — Sughrue Mion, PLLC

(57) ABSTRACT

A connector includes: a housing; terminals inserted in the housing from a first side of the housing; a short circuit terminal inserted in the housing from a second side of the housing, having contact pieces configured to contact the terminals respectively, and connecting the terminals to each other; and a front holder attached to the housing from the second side of the housing, configured to retain the terminals in the housing, and having a displacement portion. The displacement portion of the front holder attached to the housing displaces the contact pieces of the short circuit terminal inserted in the housing with the terminals not inserted in the housing, by a prescribed distance in a direction of separating the contact pieces from the terminals.

1 Claim, 8 Drawing Sheets

CONNECTOR HAVING SHORT CIRCUIT TERMINAL

CROSS REFERENCE TO RELATED APPLICATION

This application is based upon and claims the benefit of priority from the prior Japanese Patent Application No. 2016-172796, filed on Sep. 5, 2016, the entire contents of which are incorporated herein by reference.

BACKGROUND

1. Technical Field

The disclosure relates to a connector, and more specifically to a connector having a short circuit terminal which connects terminals housed in a housing to each other.

2. Related Art

Japanese Unexamined Patent Application Publication No. 2015-99683 describes a connector provided with: a housing; terminals inserted in the housing from one side of the housing; a short circuit terminal inserted in the housing from the other side of the housing, having contact pieces configured to contact the terminals, and connecting the terminals to each other; and a front holder attached to the other side of the housing, and configured to retain the terminals.

In the above connector, the terminals are inserted in the housing from one side of the housing after the short circuit terminal is inserted in the housing from the other side of the housing and the front holder is attached to the other side of the housing, so that the terminals slide on the contact pieces of the short circuit terminal and displace the contact pieces, and repulsive force of the contact pieces causes the contact pieces to contact the terminals.

SUMMARY

The above connector has a poor attachment property, since insertion of the terminals in the housing causes displacement of the contact pieces of the short circuit terminal, and therefore all repulsive force generated by the displacement of the contact pieces is applied to the terminals, increasing the insertion force of the terminals to the housing.

The disclosure aims to provide a connector which can reduce the insertion force of the terminals to the housing and improve the attachment property.

A connector in accordance with some embodiments includes: a housing; terminals inserted in the housing from a first side of the housing; a short circuit terminal inserted in the housing from a second side of the housing, having contact pieces configured to contact the terminals respectively, and connecting the terminals to each other; and a front holder attached to the housing from the second side of the housing, configured to retain the terminals in the housing, and having a displacement portion. The displacement portion of the front holder attached to the housing displaces the contact pieces of the short circuit terminal inserted in the housing with the terminals not inserted in the housing, by a prescribed distance in a direction of separating the contact pieces from the terminals.

According to the configuration above, the displacement port on of the front holder displaces the contact pieces by a prescribed distance, since the front holder is attached to the housing before the terminals are inserted in the housing. The displacement portion therefore receives repulsive force of the contact pieces displaced by a prescribed distance.

The terminals are then inserted in the housing and contact the contact nieces in a state where the contact pieces are displaced by a prescribed distance by the displacement portion. The terminals are therefore inserted in the housing while receiving the remaining repulsive force of the contact pieces excluding the repulsive force received by the displacement portion, and the insertion force of the terminals to the housing can be reduced.

Accordingly, the above connector can reduce the insertion force. of the terminals to the housing and improve the attachment property.

DETAILED DESCRIPTION

Figure 1:
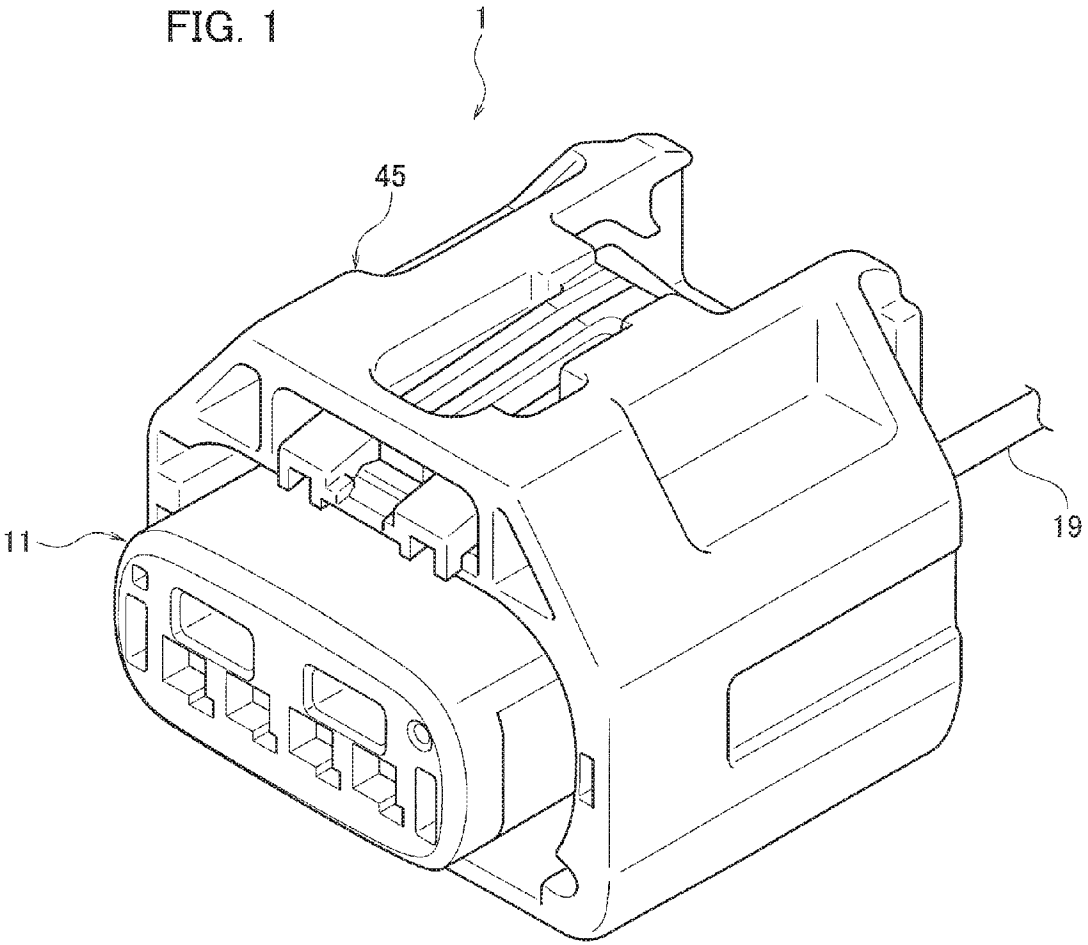
FIG. 1 is a perspective view of a connector according to an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be herein below provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
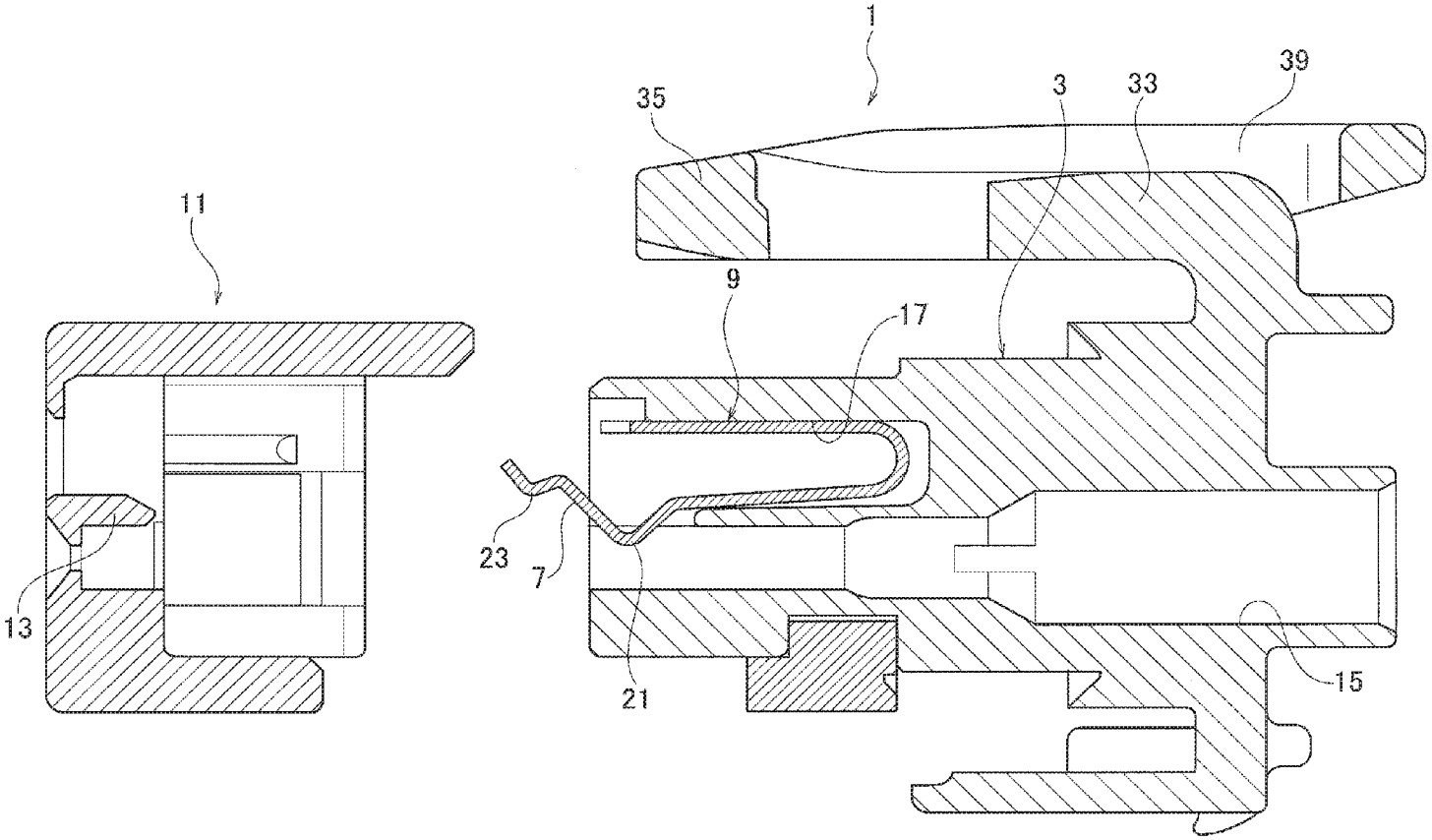
FIG. 2 is a sectional view illustrating a state before a front holder is attached to a housing of a connector according to an embodiment.
Figure 3:
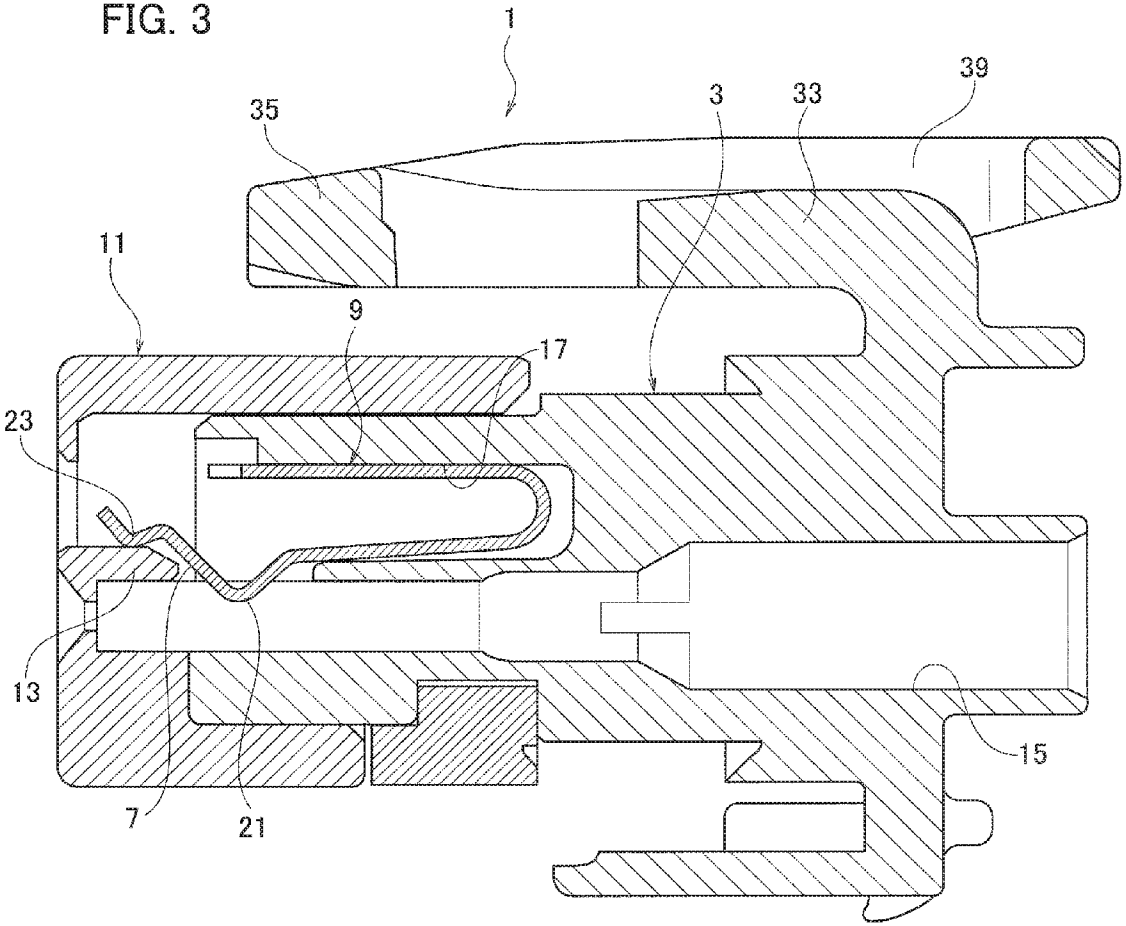
FIG. 3 is a sectional view illustrating a state after a front holder is attached to a housing of a connector according to an embodiment.
Figure 4:
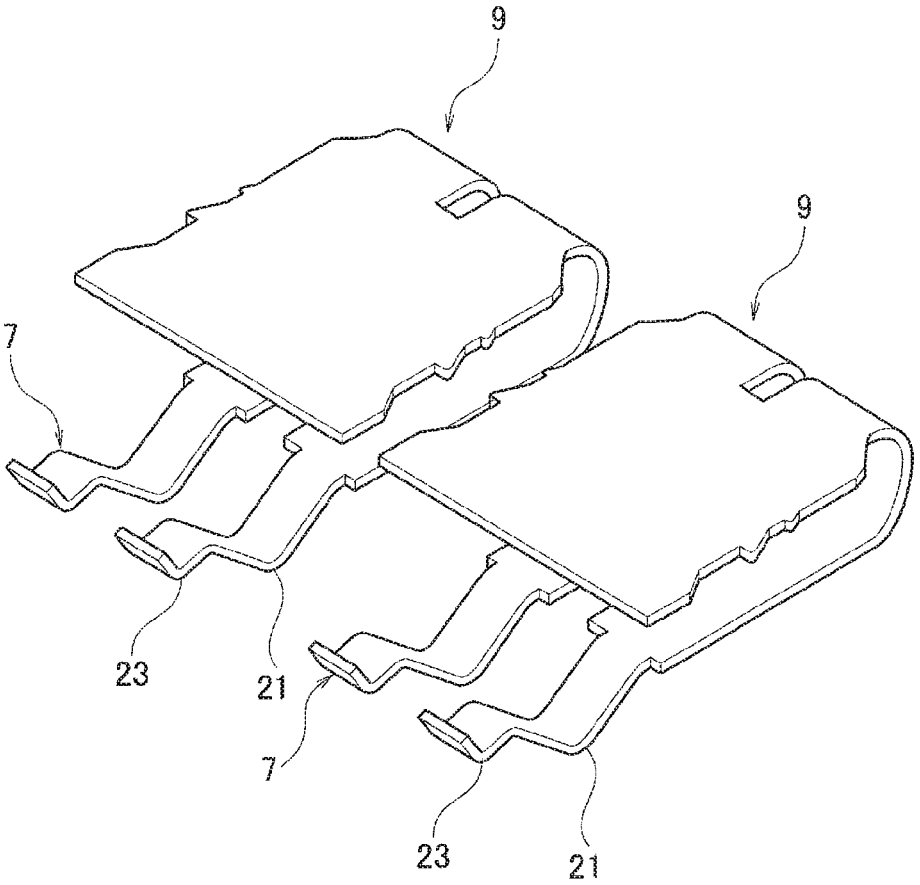
FIG. 4 is a perspective view of a short circuit terminal of a connector according to an embodiment.
Figure 5:
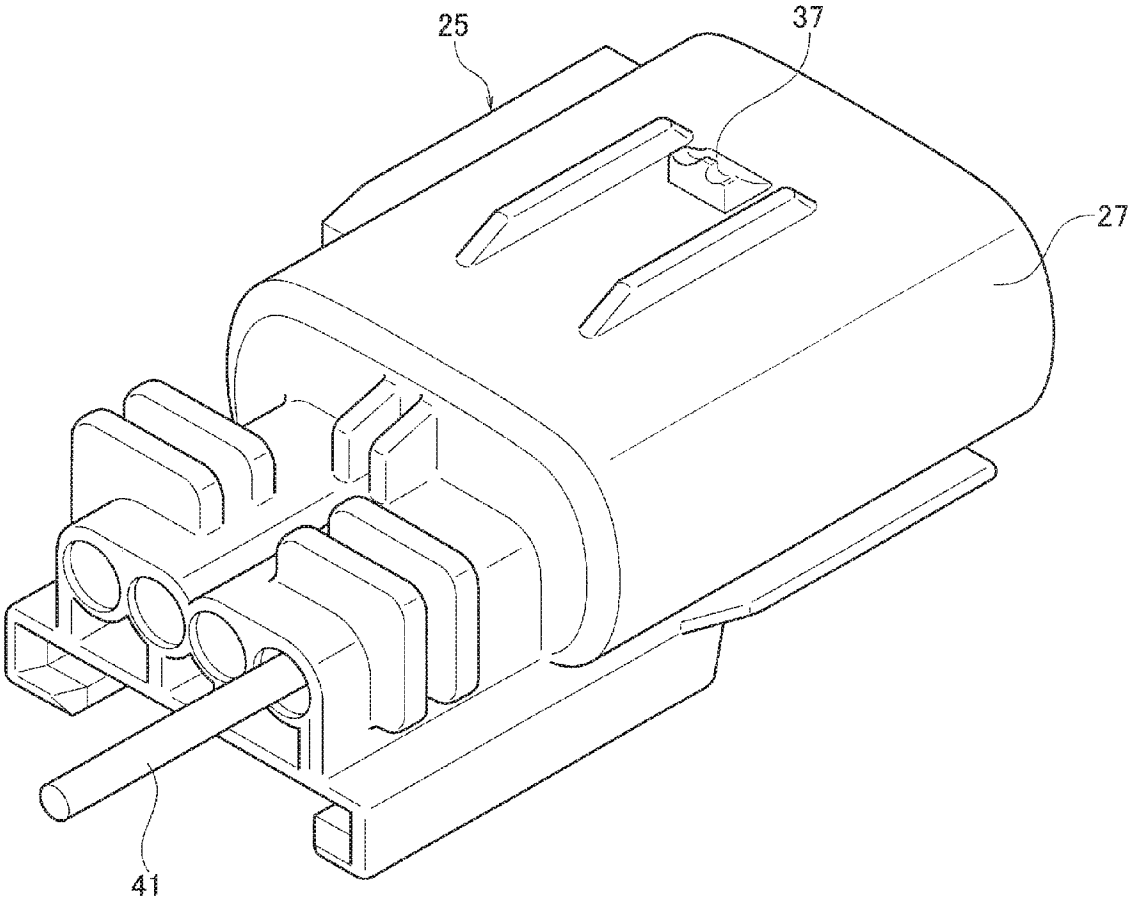
FIG. 5 is a perspective view of a counterpart housing which can be fitted to a connector according to an embodiment.
Figure 6:
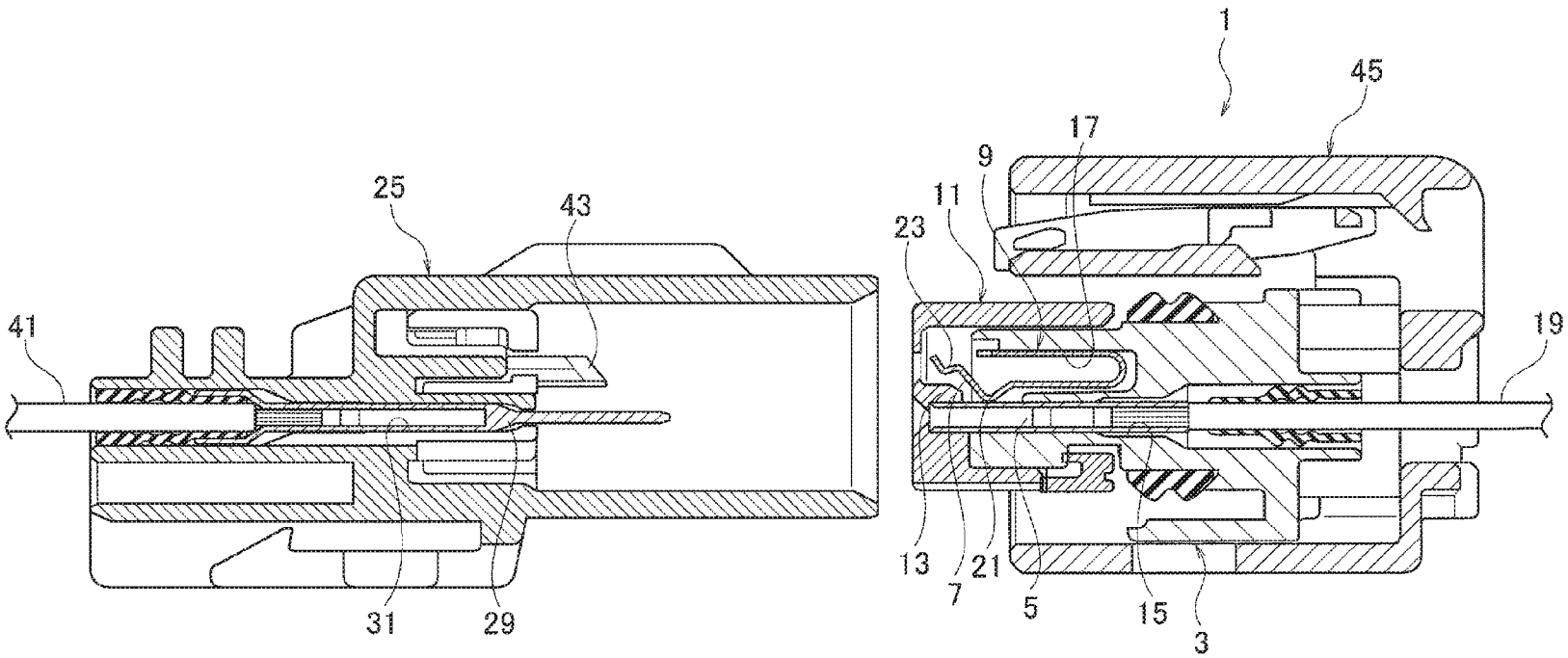
FIG. 6 is a sectional view illustrating a state before a connector according to an embodiment is fitted to a counterpart housing.
Figure 7:
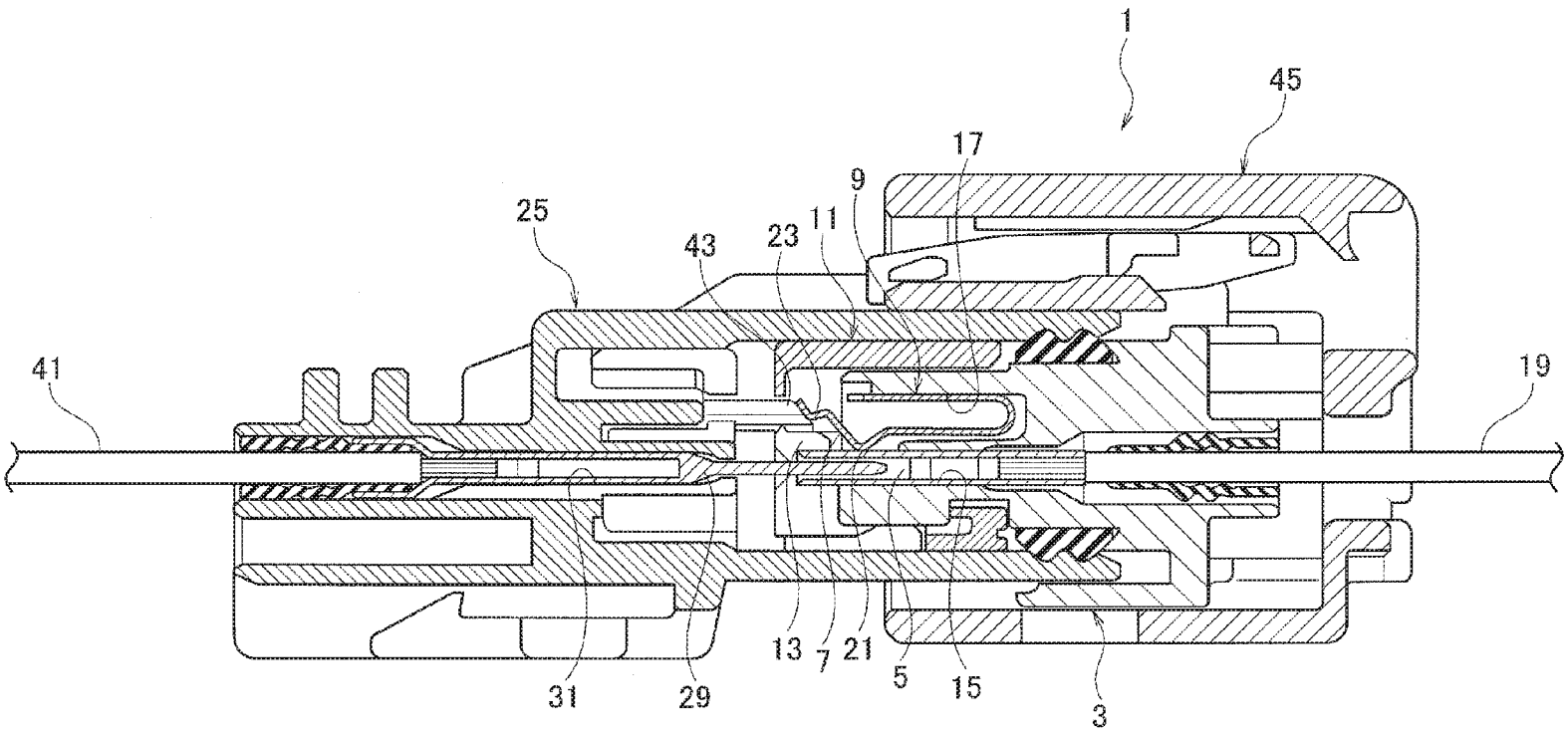
FIG. 7 is a sectional view illustrating a state where a connector according to an embodiment is being fitted to a counterpart housing.
Figure 8:
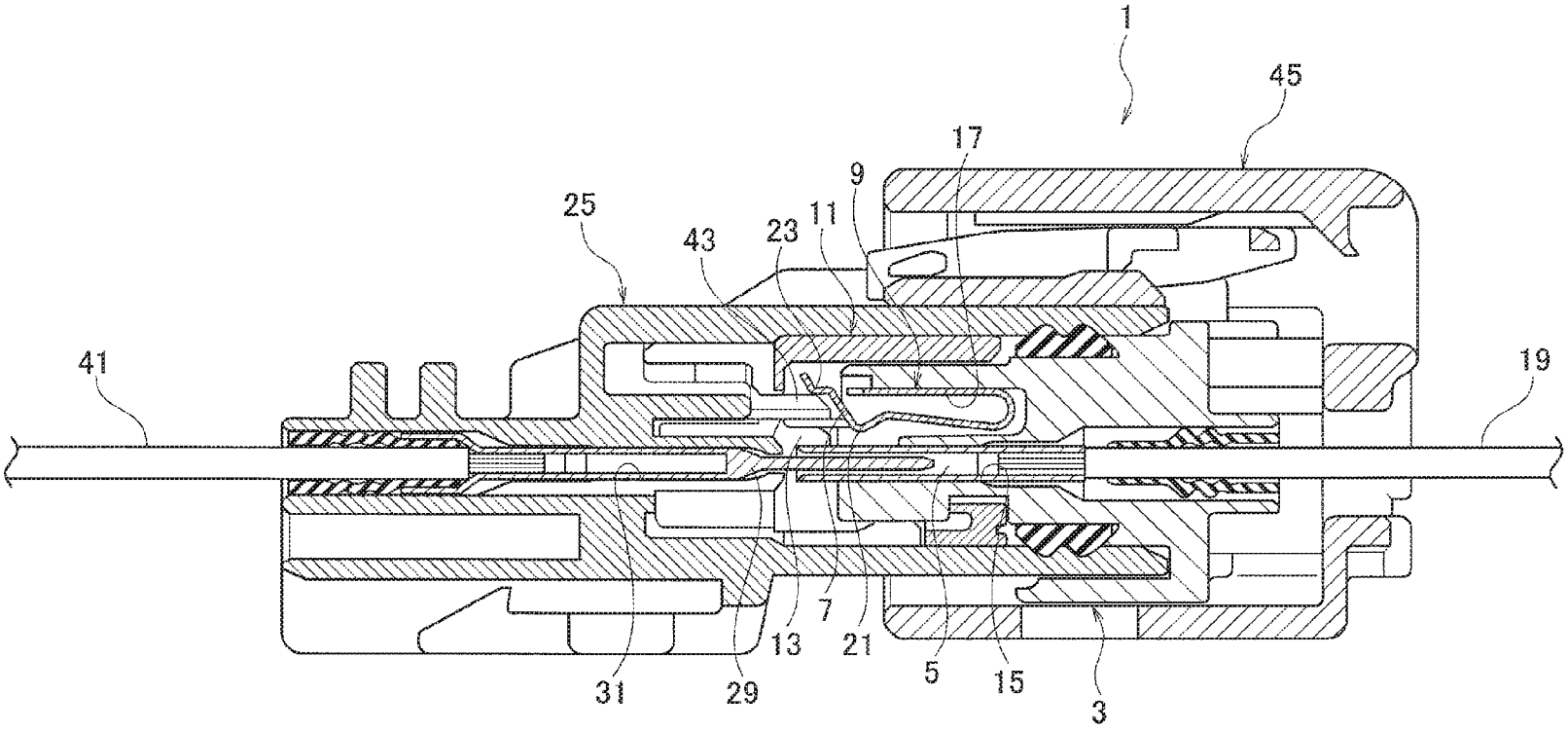
FIG. 8 is a sectional view illustrating a state after a connector according to an embodiment is fitted to a counterpart housing.

A connector according to an embodiment of the present invention will now be described using FIGS. 1 to 8.

A connector 1 according to this embodiment is provided with: a housing 3; terminals 5 inserted in the housing 3 from one side of the housing 3; short circuit terminals 9 inserted in the housing 3 from the other side of the housing 3, having contact pieces 7 configured to contact the terminals 5, and connecting the terminals 5 to each other; and a front holder 11 attached to the other side of the housing 3, and configured to retain the terminals 5 (prevent the terminals 5 from dropping out of the housing 3).

The front holder 11 is provided with a displacement portion 13 which displaces the contact pieces 7 of the short circuit terminals 9 in a direction of separating the contact pieces 7 from the terminals 5.

Since the front holder 11 is attached to the housing 3 before the terminals 5 are inserted in the housing 3, the displacement portion 13 displaces the contact pieces 7 by a prescribed distance.

The terminals 5 are inserted in the housing 3 and contacted by the contact pieces 7 in a state where the contact pieces 7 are displaced by a prescribed distance by the displacement portion 13.

The housing 3 is made of an insulating material such as synthetic resin. As illustrated in FIGS. 1 to 8, the housing 3 is provided with: terminal housing chambers 15 each having an opening in which a terminal 5 can be inserted on one side of the housing 3; and short circuit terminal housing chambers 17 each having an opening in which a short circuit terminal 9 can be inserted on the other side of the housing 3.

In the housing 3, the terminals 5 are respectively housed in the terminal housing chambers 15 from openings on one side, and short circuit terminals 9 are respectively housed in the short circuit terminal housing chambers 17 from openings on the other side.

Each of the terminals 5 is constituted at a female terminal having a box-shaped connection portion. The terminals 5 are respectively connected electrically to ends of electric wires 19 connected to an airbag circuit configured to control operations of an airbag, for example.

Each of the terminals 5 is inserted in a terminal housing chamber 15 from an opening on one side of the housing 3 and engages with a locking lance provided in the terminal housing chamber 15, a spacer inserted in the terminal housing chamber 15, or the like, so that the terminal 5 is retained in the terminal housing chamber 15.

The terminals 5 are electrically connected to each other by the short circuit terminals 9 housed in the short circuit terminal housing chambers 17, in order to prevent erroneous inflating of an airbag due to a potential difference generated between the terminals 5 by static electricity or the like when the connector 1 is put alone.

Each of the short circuit terminals 9 is constituted of a sheet of a conductive material subjected to press working or folding. Each of the short circuit terminals 9 is housed in a short circuit terminal housing chamber 17 from an opening on the other side of the housing 3, and has two elastically deformable contact pieces 7 at an end portion.

Each contact piece 7 is provided with a contact portion 21 protruded toward a terminal 5 on a free end side in a state where the short circuit terminal 9 is housed in a short circuit terminal housing chamber 17.

Prescribed energizing force of a pair of contact pieces 7 causes the contact portions 21 of the contact pieces 7 to contact the circumference surface of two adjacent terminals 5, so that the two adjacent terminals 5 become electrically connected to each other via a short circuit terminal 9.

When two terminals 5 are electrically connected to each other via a short circuit terminal 9 in such a manner, no potential difference is generated between the two terminals 5, and erroneous inflating of an airbag can be prevented.

A contact piece 7 provided with such a contact portion 21 is further provided with a sliding portion 23, which is protruded more slightly than the contact portion 21 in the same direction as the contact portion 21, at a position nearer to the free end than the contact portion 21 in a state where the short circuit terminal 9 is housed in a short circuit terminal housing chamber 17.

The sliding portion 23 slides on the displacement portion 13 provided at the front holder 11 to be attached to the housing 3, and displaces the contact piece 7 by a prescribed distance in a direction of separating the contact piece 7 from the terminal 5.

The front holder 11 is made of an insulating material such as synthetic resin. The front holder 11 is attached to the housing 3 so as to close the openings on the other side of the housing 3, and retains the terminals 5, which are inserted in the terminal housing chambers 15, to the terminal housing chambers 15.

The front holder 11 is attached to the other side of the housing 3 in a state where the short circuit terminals 9 are housed in the short circuit terminal housing chambers 17, before the terminals 5 are housed in the terminal housing chambers 15.

By attaching the front holder 11 to the other side of the housing 3 where the short circuit terminals 9 are located in such a manner, the short circuit terminals 9 can be protected by the front holder 11, deformation of the contact pieces 7 of the short circuit terminals 9 due to external force or the like can be prevented, and connection reliability of the terminals 5 and the short circuit terminals 9 can be maintained.

In addition, the number of components is not increased since the front holder 11 has not only a function of retaining the terminals 5 but also a function of protecting the short circuit. terminals 9.

Such a front holder 11 is provided with a displacement portion 13 which displaces the contact pieces 7 of the short circuit terminals 9 by a prescribed distance.

The displacement portion 13 is formed of a member continuous to the front holder 11 so as to be projected from the internal surface of the front holder 11 toward the housing 3 side and have an inclined plane at the tip side, and is located at such a position that the displacement portion 13 can abut on the sliding portions 23 of the contact pieces 7 of the short circuit terminals 9.

This displacement portion 13 slides on the sliding portions 23 of the contact pieces 7 of the short circuit terminals 9 and displaces the contact pieces 7 by a prescribed distance in a direction of separating the contact pieces 7 from the terminals 5, since the front holder 11 is attached to the other side of the housing 3 in a state where the short circuit terminals 9 are housed in the short circuit terminal housing chambers 17.

Here, displacement of a contact piece 7 by a prescribed distance by the displacement portion 13 indicates the displacement magnitude of the contact piece 7 having a contact portion 21 which can abut on the outer surface of a terminal 5 when the terminal 5 is inserted in a terminal housing chamber 15.

Since each terminal 5 is inserted in a terminal housing chamber 15 from an opening on one side of the housing 3 in a state where a contact piece 7 is displaced by a prescribed distance by the displacement portion 13, the contact portion 21 of the contact piece 7 slides on the outer surface of the terminal 5 so that the contact piece 7 is displaced in a direction of separating the contact piece 7 from the terminal 5 while repulsive force generated by the displacement of the contact piece 7 causes the contact portion 21 to contact the outer surface of the terminal 5.

By inserting each terminal 5 in a terminal housing chamber 15 in a state where the contact piece 7 is displaced by a prescribed distance in such a manner, force of the terminal 5 to displace the contact piece 7 can be reduced, and the insertion force of the terminal 5 into the terminal housing chamber 15 can be reduced.

Such a state where the terminals 5 are inserted in the terminal housing chambers 15 and connected to each other via the short circuit terminals 9 is released when a counterpart housing 25 is fitted to the housing 3.

The counterpart housing 25 is made of an insulating material such as synthetic resin. The counterpart housing 25 is provided with: a hood 27 which can be fitted to the front holder 11 side of the housing 3; and terminal housing chambers 31 configured to respectively house counterpart terminals 29 on the bottom side of the hood 27.

In the counterpart housing 25, the counterpart terminals 29 are housed in the terminal housing chambers 31 from openings on one side.

The counterpart housing 25 is provided with an engaging projection 37 which can engage with an engaging portion 35 of a lock arm 33 which is provided at the housing 3 so as to be deflectable. Engagement of the engaging portion 35 and the engaging projection 37 maintains fitting of the counterpart housing 25 and the housing 3.

The fitting sate of the counterpart housing 25 and the housing 3 can be released when a releasing arm 39 provided at the housing 3 so as to be deflectable is pushed and the engagement of the engaging portion 35 and the engaging projection 37 is released.

Each of the counterpart terminals 29 is constituted of a male terminal having a tab-shaped connection portion which can be inserted in the box-shaped connection portion of a terminal 5, and is electrically connected to an end of each of electric wires 41 connected to a power supply, equipment or the like.

Each of the counterpart terminals 29 is inserted in a terminal housing chamber 31 from an opening on one side of the counterpart housing 25 and engages with a locking lance provided in the terminal housing chamber 31, a spacer inserted in the terminal housing chamber 31, or the like, so that the counterpart terminal 29 is retained in the terminal housing chamber 31.

The counterpart terminals 29 are electrically connected to the terminals 5 housed in the housing 3 when the front holder 11 side of the housing 3 is fitted in the hood 27 of the counterpart housing 25.

For connecting the counterpart terminals 29 and the terminals 5 to each other, it is necessary to release the connection of the terminals 5 and the short circuit terminals 9, since the terminals 5 are connected to each other via the short circuit terminals 9.

Hence, the counterpart housing 25 is provided with a releasing portion 43 configured to displace the contact pieces 7 of the short circuit terminals 9 and release the connection of the terminals 5 and the short circuit terminals 9.

The releasing portion 43 is formed of a member continuous to the counterpart housing 25 so as to be projected from a bottom of the hood 27 toward inside of the hood 27 and have an inclined plane at a tip side, and is located at such a position that the releasing portion 43 can abut on the sliding portions 23 of the contact pieces 7 of the short circuit terminals 9.

When the counterpart housing 25 and the hosing 3 are fitted to each other, the releasing portion 43 slides on the sliding portions 23 of the contact pieces 7 of the short circuit terminals 9, displaces the contact pieces 7 in a direction of separating the contact pieces 7 from the terminals 5, and releases the contact of the contact portions 21 of the contact pieces 7 and the outer surface of the terminals 5.

The releasing portion 43 abuts on the sliding portions 23 of the contact pieces 7 in a state where the counterpart housing 25 and the housing 3 are fitted to each other, so that displacement of the contact pieces 7 to the terminal 5 side is prevented, and contact of the contact portions 21 of the contact pieces 7 and the outer surface of the terminals 5 is prevented.

Since the counterpart housing 25 is provided with the releasing portion 43 in such a manner, the terminals 5 are not connected to each other via the short circuit terminals 9 in a state where the counterpart housing 25 and the housing 3 are fitted to each other, that is, a state where the counterpart terminals 29 and the terminals 5 are connected to each other.

A detection member 43 which can move in a fitting direction of the counterpart housing 25 and the housing 3 is attached to the circumference of the housing 3.

The detection member 45 is attached to the circumference of the housing 3 at a temporal locking position which can move toward the front side along the fitting direction, so that the detection member 45 can move to a final locking position on the front side along the fitting direction when the counterpart housing 25 and the housing 3 are fitted properly to each other, or cannot move to the final locking position when the counterpart housing 25 and the housing 3 are not fitted properly to each other.

The fitting state of the housing 3 and the counterpart housing 25 can be detected based on whether the detection member 45 can move from the temporal locking position to the final locking position or not.

Regarding the connector 1, the front holder 11 is attached to the housing 3 before the terminals 5 are inserted in the housing 3, so that the displacement portion 13 displaces the contact pieces 7 by a prescribed distance. The displacement portion 13 therefore receives repulsive force of the contact pieces 7 displaced by a prescribed distance.

Moreover, the terminals 5 are inserted in the housing 3 and contacted by the contact pieces 7 in a state where the contact pieces 7 are displaced by a prescribed distance by the displacement portion 13. The terminals 5 are therefore inserted in the housing 3 while receiving the remaining repulsive force of the contact pieces 7 excluding the repulsive force received by the displacement portion 13, so that the insertion force of the terminals 5 to the housing 3 can be reduced.

Accordingly, the connector 1 can reduce the insertion force of the terminals 5 to the housing 3 and improve the attachment property.

Although a short circuit terminal of a connector according to an embodiment of the present invention is provided with two contact pieces configured to contact adjacent terminals, it is to be noted that the present invention is not limited to this and a short circuit terminal may be provided with three or more contact pieces configured to contact terminals.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A connector comprising:

a housing;

terminals inserted in the housing from a first side of the housing;

a short circuit terminal inserted in the housing from a second side of the housing, having contact pieces configured to contact the terminals respectively, and connecting the terminals to each other; and a front holder attached to the housing from the second side of the housing, configured to retain the terminals in the housing, and having a displacement portion, wherein the displacement portion of the front holder attached to the housing displaces the contact pieces of the short circuit terminal inserted in the housing with the terminals not inserted in the housing, by a prescribed distance is a direction of separating the contact pieces from the terminals.

* * * * *